US006854210B2

(12) United States Patent
Gunderman

(10) Patent No.: US 6,854,210 B2
(45) Date of Patent: Feb. 15, 2005

(54) ABOVE GROUND CONTAINER STABILIZER

(75) Inventor: John E. Gunderman, Inver Grove Heights, MN (US)

(73) Assignee: Cherokee Manufacturing, Inc., So. St. Paul, MN (US)

( * ) Notice: Subject to any disclaimer, the term of this patent is extended or adjusted under 35 U.S.C. 154(b) by 103 days.

(21) Appl. No.: 10/007,117

(22) Filed: Nov. 9, 2001

(65) Prior Publication Data

US 2003/0089032 A1 May 15, 2003

(51) Int. Cl.[7] ..... A01G 9/02
(52) U.S. Cl. ..... 47/39
(58) Field of Search ..... 47/39, 68, 40, 47/904, 45; 211/85.23, 71.01, 85.31; D11/148, 131.1, 152–154; 248/107, 153, 175

(56) References Cited

U.S. PATENT DOCUMENTS

| | | | | | |
|---|---|---|---|---|---|
| 822,277 | A | * | 6/1906 | Hotchkiss | 211/33 |
| 967,368 | A | * | 8/1910 | Grigsby | 4/285 |
| 1,173,210 | A | * | 2/1916 | Ochs | 422/306 |
| 1,550,708 | A | * | 8/1925 | Rozendal | 47/47 |
| 2,235,986 | A | * | 3/1941 | Ellingson | 248/153 |
| 2,506,321 | A | * | 5/1950 | Vosburgh | 248/153 |
| 3,796,402 | A | * | 3/1974 | Trotta | 248/97 |
| 4,283,032 | A | * | 8/1981 | Smith | 248/97 |
| 5,050,339 | A | * | 9/1991 | Howell | 47/39 |
| 6,119,393 | A | * | 9/2000 | Wourms et al. | 47/39 |
| 6,454,225 | B1 | * | 9/2002 | Jaworski | 248/153 |

FOREIGN PATENT DOCUMENTS

| | | | | | |
|---|---|---|---|---|---|
| JP | 408038322 | A | * | 2/1996 | A47G/7/02 |
| JP | 08242697 | A | * | 9/1996 | A01G/9/00 |
| JP | 10211072 | A | * | 8/1998 | A47G/7/02 |

* cited by examiner

*Primary Examiner*—Son T Nguyen
(74) *Attorney, Agent, or Firm*—Oppenheimer Wolff & Donnelly LLP

(57) ABSTRACT

A unitary elongated member comprises bends at predetermined locations to form an upper ring and a lower ring. A vertical portion connecting the upper ring to the lower ring, orienting the upper and lower rings in a parallel, vertically spaced, horizontally disposed orientation such that the upper and lower rings are centered about a vertical axis. The lower ring has a larger diameter than the upper ring and is adapted rest on the ground or a floor. The elongated member is rigid yet sufficiently malleable to be manipulated by a user to be adjusted to support various sized plant containers. The elongated unitary member may be made of galvanized wire or plastic material resistant to rust. The rings are shaped so as to define an inner volume of the plant support to accommodate the insertion of a plant container housing a plant. The plant container is adapted rest on the upper ring so as to position the plant container above the ground. The upper ring is easily adjusted to receive differing sized containers by manually increasing or decreasing the upper ring diameter. Additionally, the present invention provides a more stable plant support since each the lower ring can be easily adjusted by either manually increasing of decreasing the lower ring diameter. In an alternative embodiment of the present invention, additional vertical portions or legs are provided to provide additional support and stability.

33 Claims, 10 Drawing Sheets

ABOVE GROUND CONTAINER STABILIZER

FIELD OF THE INVENTION

This invention relates generally to plant support structures. More particularly the present invention relates to an inexpensive multi-purpose structure that operates as a support for plants residing in containers.

BACKGROUND OF THE INVENTION

Many different devices are used to help plants through their different stages of development. Some plant species grow to be quite tall and have long branches and vines. To prevent these plants from dying, they must be supported and protected to minimize damage from harsh handling and environmental conditions.

In the culturing and development of potted plants or plants resident in a container, many times a stand or support is used to position the potted plant on the ground or floor a in predetermined orientation. The users of stands, such as gardeners and nursery operators, use the stands to prevent toppling of the plant due to wind or inadvertent bumping. Additionally, the stands facilitate moving of plants and optimize the use of storage or floor space.

To prevent having to buy and assemble different support structures for plants in various sized containers and frequently replace the support structures due to deterioration, it would be advantageous to have an adjustable potted plant support structure that is resistant to fracture and deterioration. Most structures, however, do not perform both functions.

Prior plant supports commonly use wire to support plant containers, wherein wire sections are welded or fastened together. The wire structures frequently deform, or, even worse, the welds holding the wire structure together break and fracture due to formation of rust. Weld and fastener locations are where rust typically first occurs in the wire structures, which damages the structural integrity and operating life of the structure. Moreover, the rigid attachments of many support structures prevent adjustment of its shape and will fracture when the wire structure is manipulated or assembled and disassembled.

Prior support structures are lightweight which makes them susceptible to being blown over in inclement weather or knocked over by a person passing by. Additionally, prior plant supports have experienced problems due to their shape and structural orientation. For example, many plant supports have insufficient space to accommodate various sized plant containers. As plants grow, they often have to be repotted in larger containers. A new support structure must be purchased to accommodate the larger pot since the prior support structure cannot be adjusted to accommodate the larger pot. Having structurally limited support structures increases the cost of equipment for a user, and, increases the chances of losing a structure when not in use. Finally, the shape of some plant supports is disadvantageous to stacking a multiple of plant supports on top of one another. There may be a segment or portion of the plant support that prevents multiple plant supports from complementarily engaging one another in a stacking fashion.

As such, it may be appreciated that there continues to be a need for a potted plant support designed to effectively accommodate various sized containers and provides sturdy reliable support. Additionally, there is a need to provide a plant support that can withstand the rugged handling associated with repeated insertion and removal of containers, and stacking. There is a desire to provide a plant support that is resistant to rust and exposure to other elements, while maintaining a high degree of stability.

SUMMARY OF THE INVENTION

It is an object of the present invention to provide a support structure for holding potted plants in an aboveground configuration.

A further object of the invention is to provide a plant support that is easily adjustable to accommodate different sized plant containers.

Another object of the invention is to provide a plant support resistant to rust and exposure to inclement weather.

Another object of the invention is to minimize the cost to ship and to minimize the amount of space needed to store a plant support.

An embodiment of the present invention comprises a unitary elongated member that is bent a predetermined locations to form an upper oval and a lower oval. A vertical portion connecting the upper oval to the lower oval, orienting the upper and lower ovals in a parallel, vertically spaced, horizontally disposed orientation such that the upper and lower ovals are centered about a vertical axis. The lower oval has a larger diameter than the upper oval and is adapted rest on the ground or a floor. The elongated member is rigid yet sufficiently malleable to be manipulated by a user to be adjusted to support various sized plant containers. The elongated unitary member may be made of galvanized wire or plastic material resistant to rust.

The rings are shaped so as to define an inner volume of the plant support. The inner volume of the plant support accommodates the insertion of a plant container. The plant container is adapted rest on the upper oval so as to position the plant container above the ground. A plant container is inserted into the interior volume of the plant support such that at least a rim or lip of the container engages the upper ring for support of the plant container.

The upper oval is easily adjusted to receive differing sized containers by manually increasing or decreasing the upper oval diameter. Additionally, the present invention provides a more stable plant support since each the lower oval can be easily adjusted by either manually increasing of decreasing the lower oval diameter. This eliminates the negative affect of rigid connections on the upper and lower ovals. Elimination of the rigid connections on the plant support prolongs the operational life of the support and minimizes breaks and fractures in the device.

In an alternative embodiment of the present invention, additional vertical portions or legs are provided to provide additional support and stability.

The foregoing and other objects, features and advantages of the invention will become more readily apparent from the following detailed description of a preferred embodiment of the invention that proceeds with reference to the accompanying drawings.

DETAILED DESCRIPTION OF THE INVENTION

Figure 1:
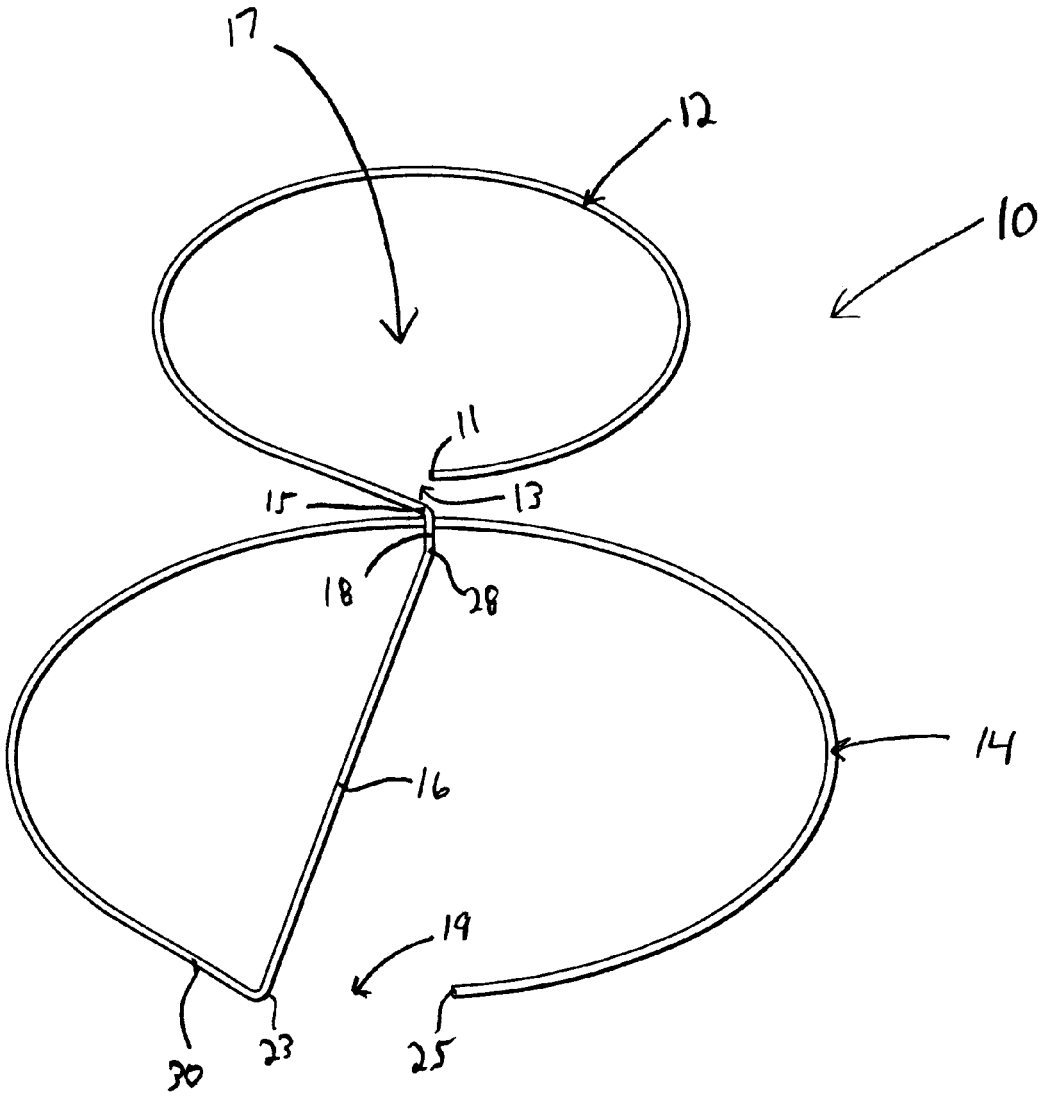
FIG. 1 is a perspective view of an embodiment of the present invention.

Various embodiments of the present invention are shown and described to support plant containers. It is to be understood that though these embodiments are shown and described in isolation, various features of each embodiment can be combined with the others to produce a variety of embodiments.

Referring to FIGS. 1–4, a first embodiment of a wire plant support is shown and generally referred to as 10. The plant support a unitary elongate member constructed of a single continuous wire having plurality of bends formed at predetermined locations to define an upper oval portion 12, a lower oval portion 14 and a vertical portion 16 extending between the upper oval and lower oval. Vertical portion 16 positions the upper oval 12 and the lower oval 14 in a substantially parallel, vertically spaced, horizontally disposed orientation such that the upper oval 12 and lower oval 14 are centered about a vertical axis. The upper oval 12 and lower oval 14 define an interior volume 17 that is adapted to receive a plant container.

Figure 2:
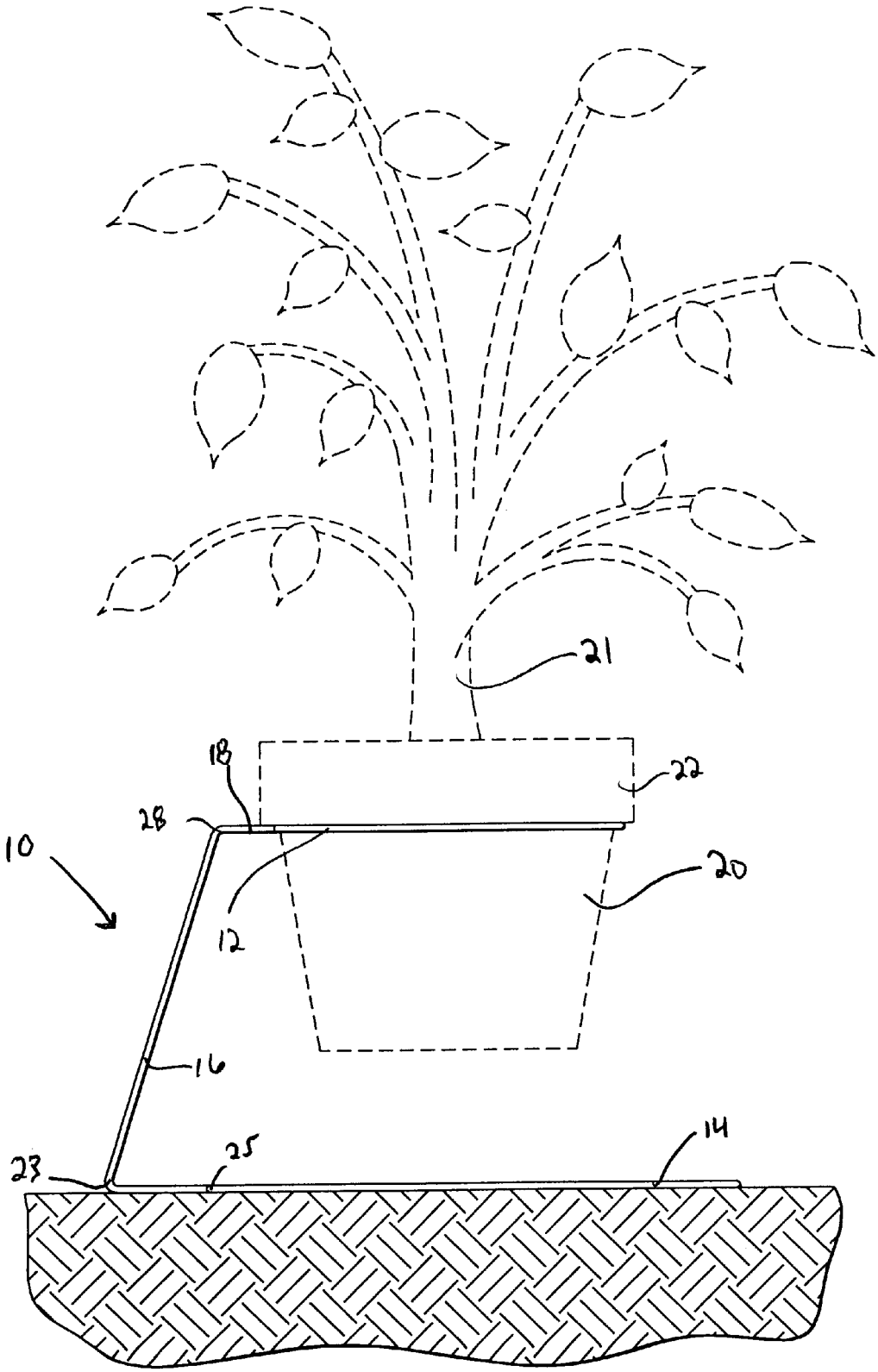
FIG. 2 is a side view of the embodiment of FIG. 1 with a potted plant held according to the present invention.
Figure 3:
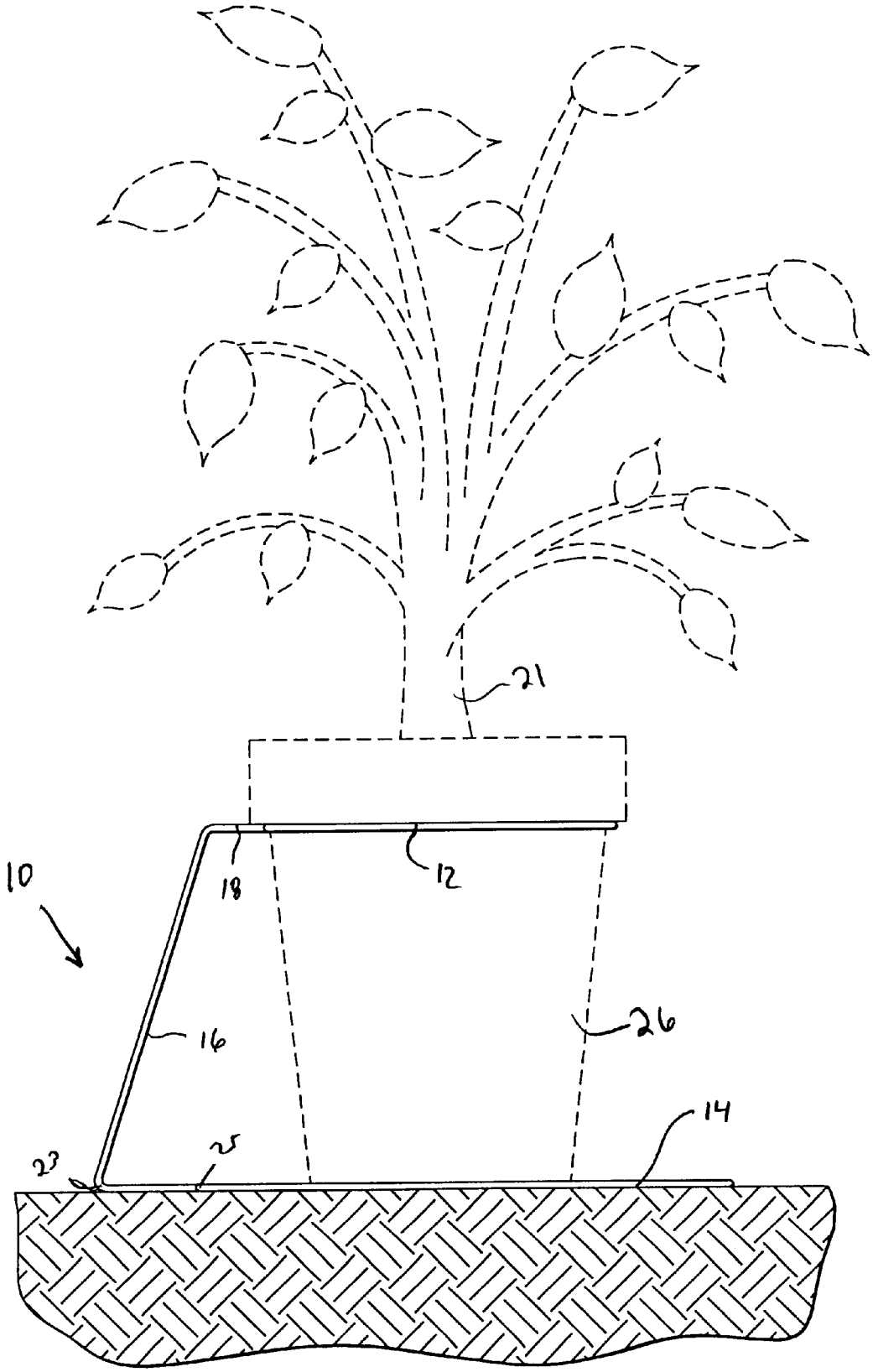
FIG. 3 is a side view of the embodiment of FIG. 1 with another potted plant held according to the present invention.
Figure 4:
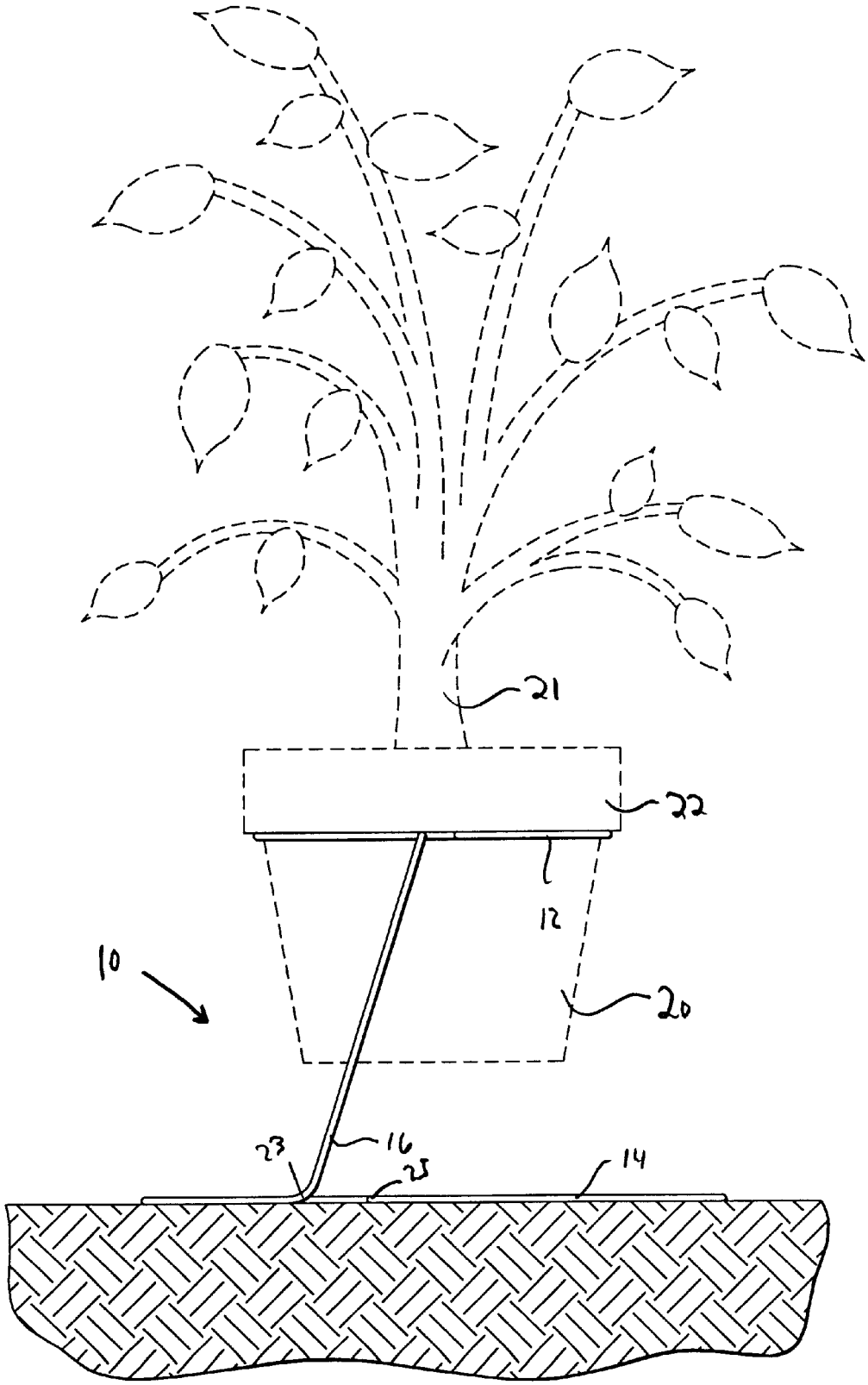
FIG. 4 is an end view of the embodiment of FIG. 1 with a potted plant held according to the present invention.

Upper oval portion 12 is almost an enclosed circle, with a space 13 separating the first end 11 and the second end 15 of upper oval portion 12. Upper oval portion 12 provides a ring member adapted to support a container, planter, or pot, or the like. As shown in FIGS. 2–4, upper oval 12 is adapted to support a container 20, housing a plant 21, that is inserted into interior volume 17. A portion of container 20, i.e., rim or lip 22, comes to rest against upper oval 12 to rigidly hold container 20 above the ground. Lower oval portion 14 is almost an enclosed circle or ring, with a space 19 separating the first end 23 and the second end 25 of lower oval portion 14. Lower oval portion 14 is formed to provide a base for plant support 10 adapted to rest on the ground or on a floor. Upper oval portion 12 is adapted to hold a container 20 suspended above the ground (see FIG. 2), or hold a container 26 in position as it rests on the ground (see FIG. 3).

Lower oval portion 14 has a larger diameter than upper oval portion 12 defining a generally tapered cylinder shape, or frustum of a circular pyramid, for plant support 10. Because of the large surface area of the lower oval portion 14, plant support 10 is more resistant to tipping over due to wind or inadvertent bumps. Moreover, the larger diameter enables weight of a supported container 20 to be distributed over a larger area, for a more durable support.

As shown in FIGS. 1–4, vertical portion 16 extends between upper oval portion 12 to lower oval portion 14, and maintains the space between the upper and lower ovals. Vertical portion 16 traces the slant line of the tapered cylindrical shape, or frustum of the circular pyramid, defined by the upper and lower ovals discussed above. Vertical portion 16 may also be positioned in a diagonal orientation, as shown in FIG. 4.

Vertical portion 16 is sufficiently rigid to maintain its shape in support of a container. However, to further enhance the supportability of vertical portion 16, a first portion 18 is formed between upper oval 12 and a first end of vertical portion 16. First portion 18 is defined by a first bend at the second end 15 of upper oval 12 and a second bend 28 at a first end of vertical portion 16. First portion 18 projects radially outwardly from the central axis of support 10, as shown in the Figures. First portion 18 may extend from upper oval 12 at any angle, or extend out of the plane of the upper oval 12. However, the angle of the bend must provide sufficient support to upper oval 12 to hold and secure a container.

As shown in FIG. 1, plant support 10 may have a second portion 30 that extends from first end 23 of vertical portion 16 to lower oval 14. Second portion 30 is defined by a bend at end 23 and the beginning of the curve of lower oval 14. Second portion 30 may be substantially straight and run along a tangent of the curve of lower oval 14. However, second portion 30 may be any shape desired.

Figure 5:
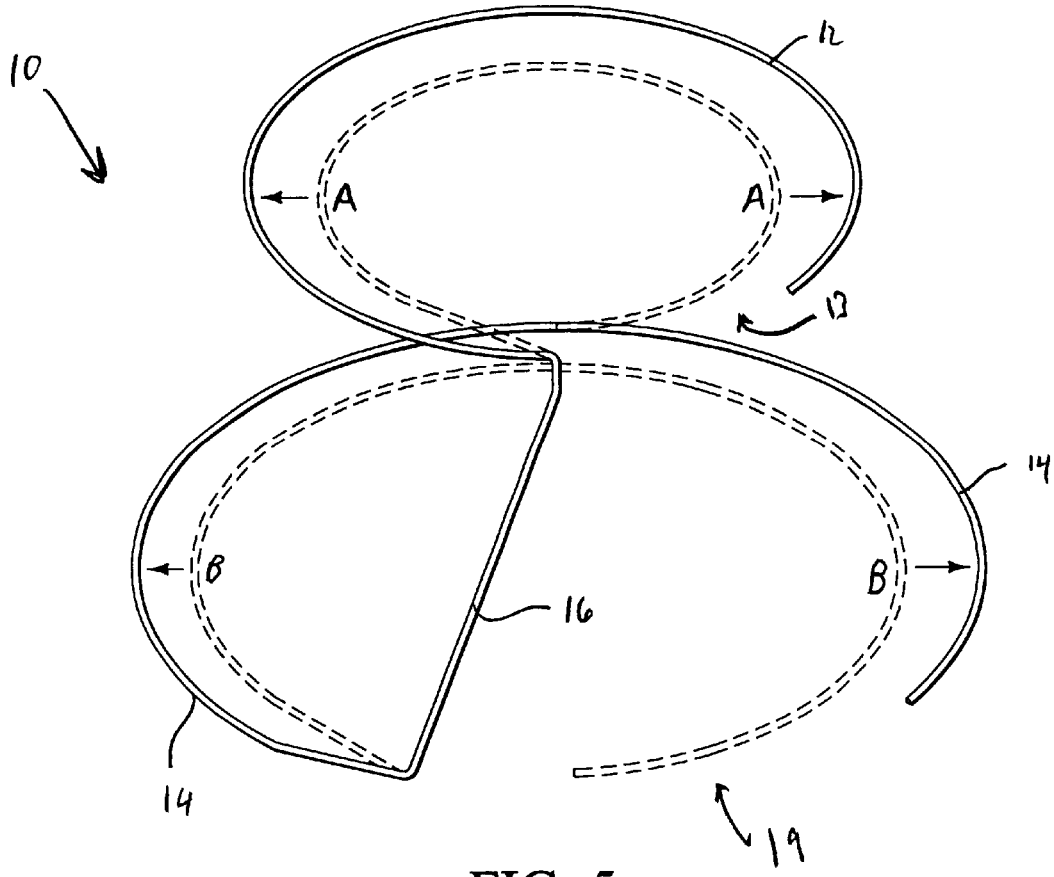
FIG. 5 is a perspective view of the present invention in an enlarged configuration, with the original configuration shown by the hidden lines.
Figure 6:
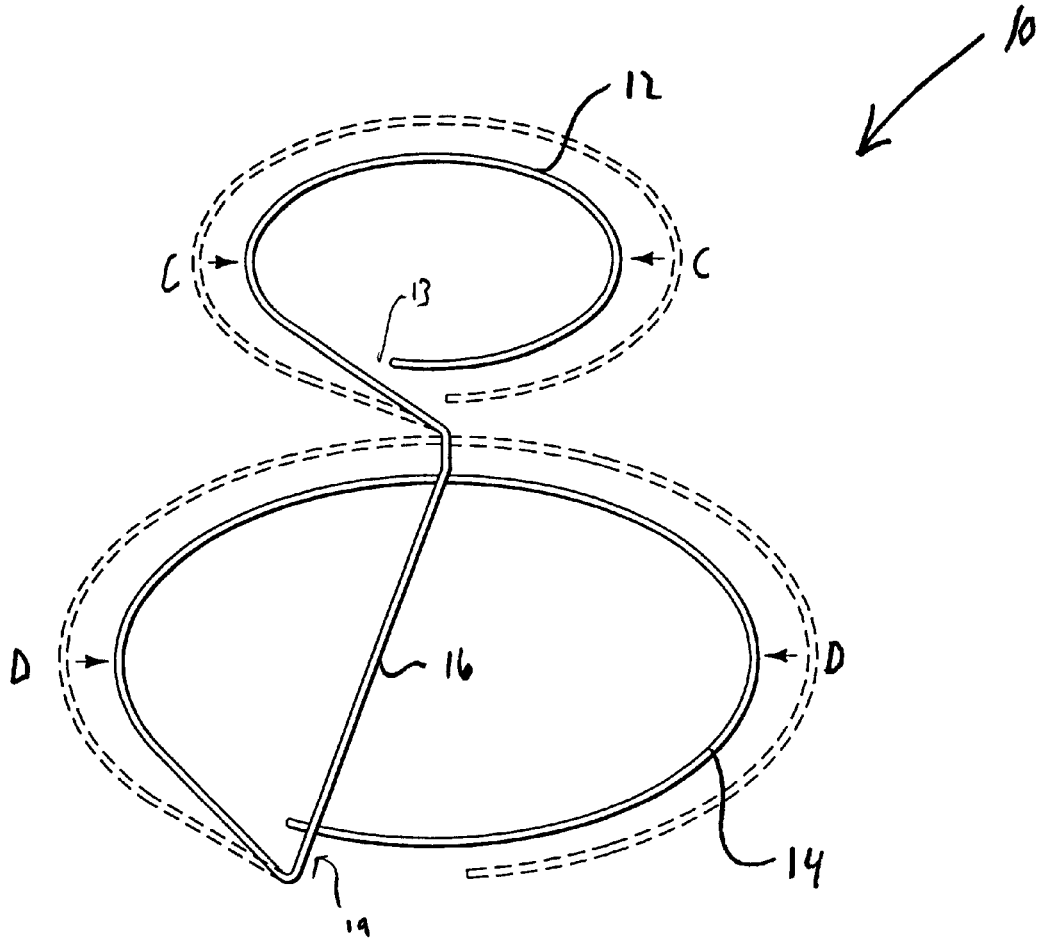
FIG. 6 is a perspective view of the present invention in a smaller configuration, with the original configuration shown by the hidden lines.

Referring to FIGS. 5 and 6, plant support 10 is easily adjusted to receive differing sized containers by manually increasing or decreasing the upper oval diameter or lower oval diameter. For example, if a user desires to insert a container larger than the upper oval 12 opening currently permits, the user manually increases the diameter of upper oval 12 as indicated by arrow A. See FIG. 5. The user grabs a location of upper oval 12 and pulls until the desired upper oval diameter is achieved. The result is an increased space 13 between first free end 11 and second end 15 of upper oval 12. The larger container is then inserted into the larger upper oval. If desired or necessary to provide a more stable base for plant support 10, the diameter of lower oval 14 may also be increased. The user will manually increase the lower oval diameter in the same manner as the upper oval, as indicated by arrow B. The result is an increased space 19 between first end 23 and second free end 25 of lower oval 14. Moreover, if the ground or floor is uneven, lower oval 14 may be manually reconfigured to complementarily engage the uneven surface, and provide a stable base of support.

To accommodate a smaller container, the diameter of the upper oval 12 and lower oval 14 may be decreased. See FIG. 6. A user may manually decrease the diameter of upper oval 12 and lower oval 14 by applying a force in the direction of the respective arrows C and D until the desired oval diameter is achieved. This activity results in a decreased space 13 between first free end 11 and second end 15 of upper oval 12. To accommodate much smaller containers, lowers oval 14 is adjusted such that first end 23 is positioned within interior volume 17, as shown in FIG. 6. This ability to adjust the diameter is beneficial because a plant support user will not be required to obtain a large number of different sized supports 10 to accommodate containers 20.

Moreover, if the present invention is deformed due to application of an external force, such as being crushed during shipment, the user may easily rehabilitate plant support 10 and manually return the device to its original configuration. The inherent properties of the elongated unitary bar permit plant support 10 to maintain its ability to return to its original supporting orientation.

The plant containers 20, 26 associated with the present invention preferably have a lip or rim to facilitate the proper positioning of a container within the inner volume 17 of plant support 10. Specifically, the rim of the container is adapted to rest over the upper surface of upper oval 12. Use of the present invention to hold plants above the ground has several benefits. First, the plant support 10 can better enable a user to properly position a plant 21 to receive light and water. Second, the plant support 10 enables a user to make more efficient use of limited space in a garden or nursery, or where plants may tend to crowd each other. Finally, the plant support 10 maintains a plant in a predetermined position, resisting tipping over by external forces while enabling a user to easily pick up and move a plant. The plant container 20, 26 is simply lifted out of the plant support 10 and moved to another location.

Figure 7:
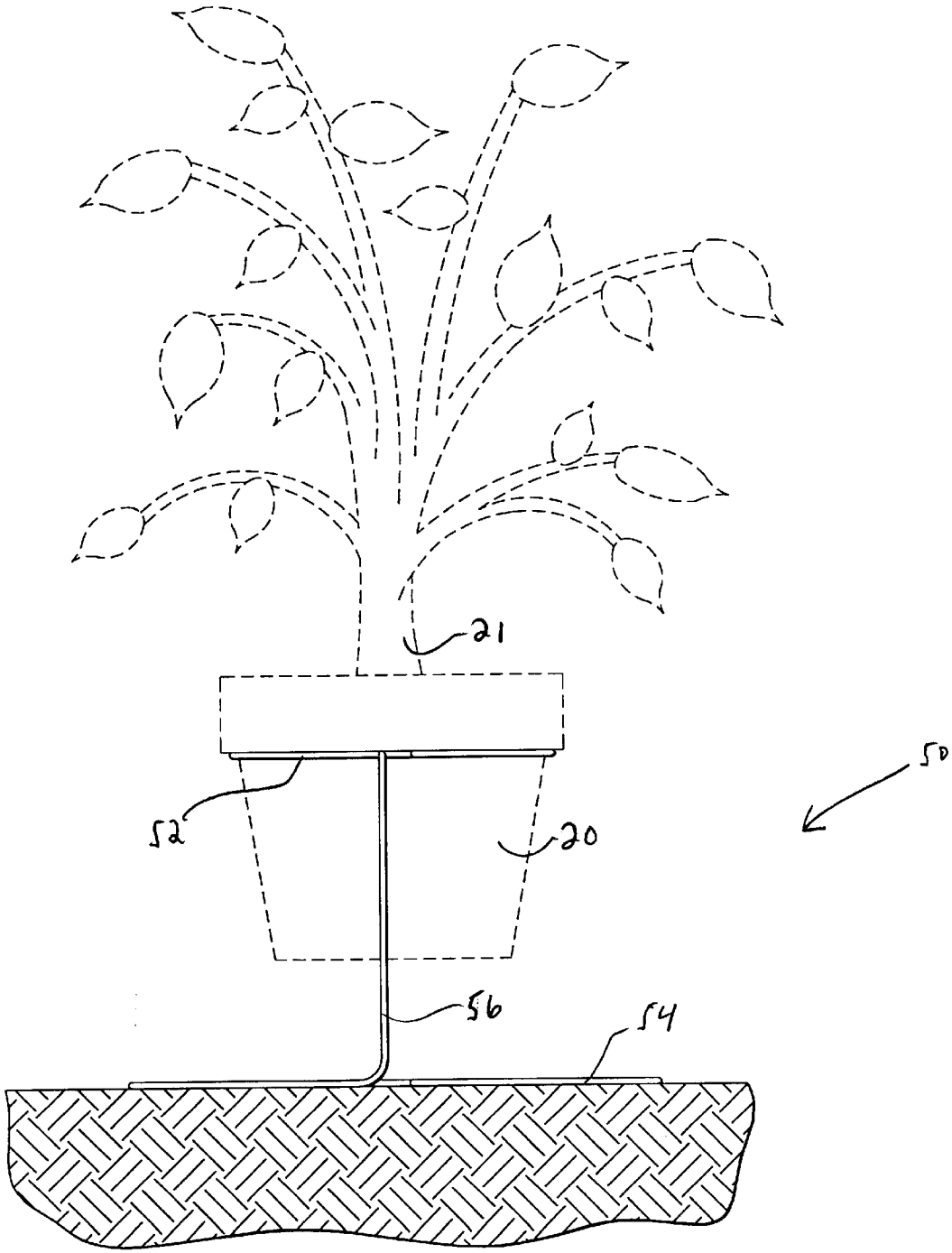
FIG. 7 is an end view of an alternative embodiment of the present invention.

Shown in FIG. 7 is an alternative embodiment of the present invention 50 comprising a vertical portion 56 in an alternative configuration. Vertical portion 56 is oriented in a plane substantially perpendicular to the planes of upper oval 52 and lower oval 54. This embodiment demonstrates that the vertical portion of the present invention may be formed in various orientations or angles relative to the upper and lower ovals, yet still perform as described above to support a plant container 20.

Figure 8:
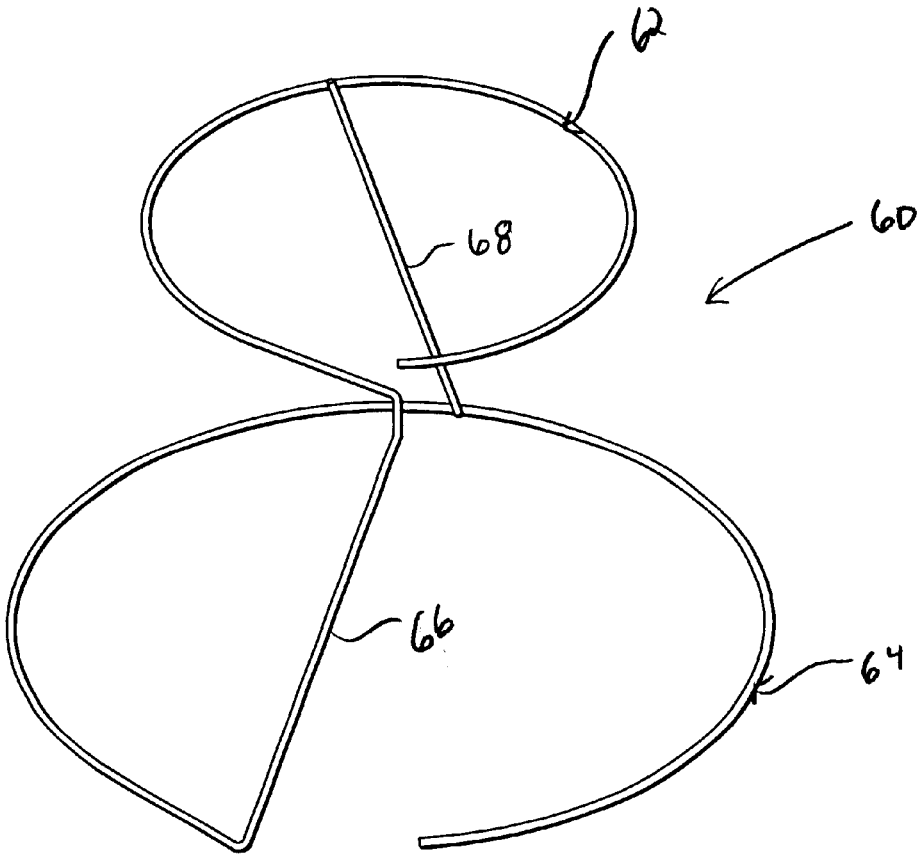
FIG. 8 is a perspective view of an alternative embodiment of the present invention.
Figure 9:
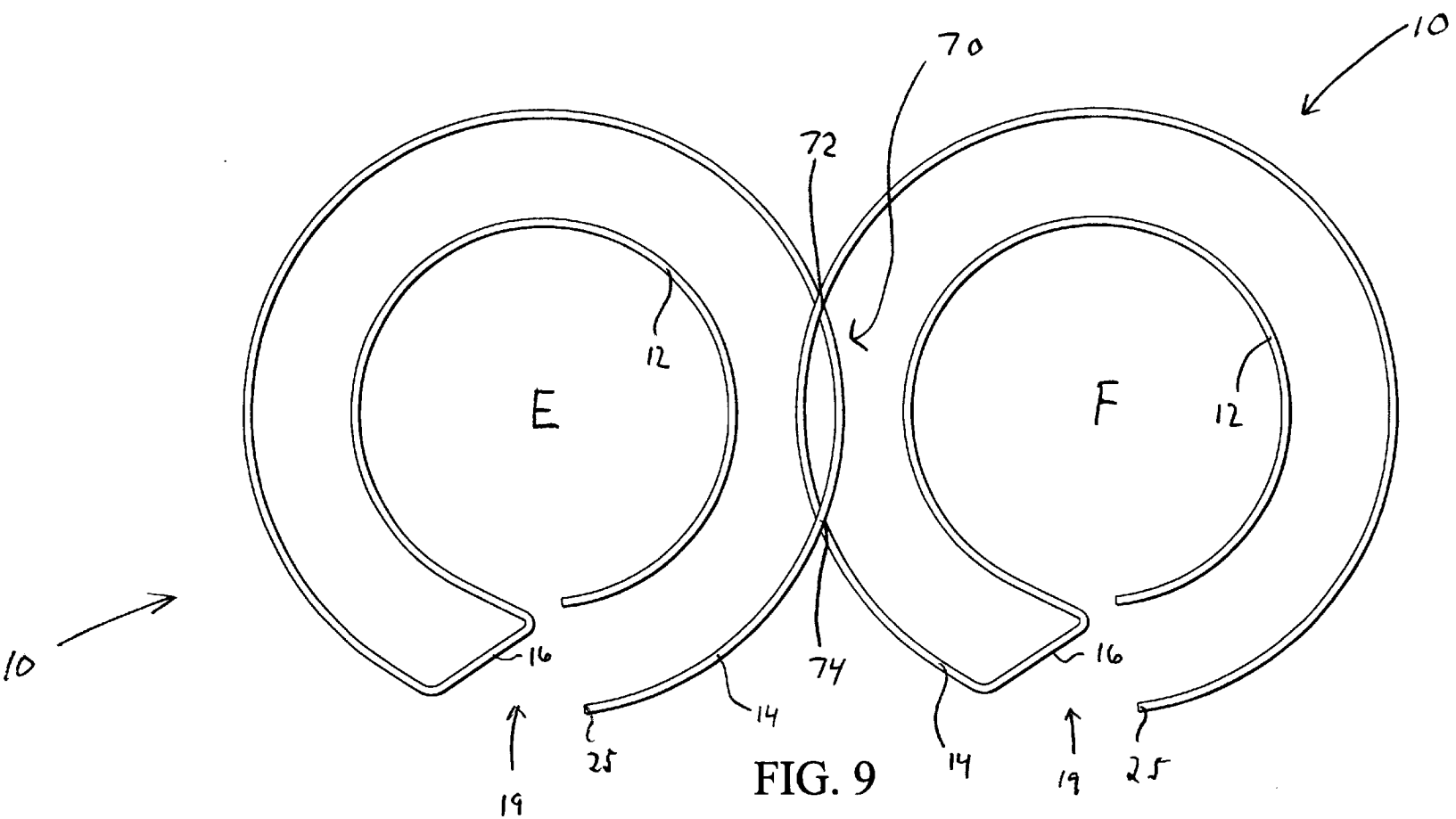
FIG. 9 is a top view of an alternative embodiment of the present invention.
Figure 10:
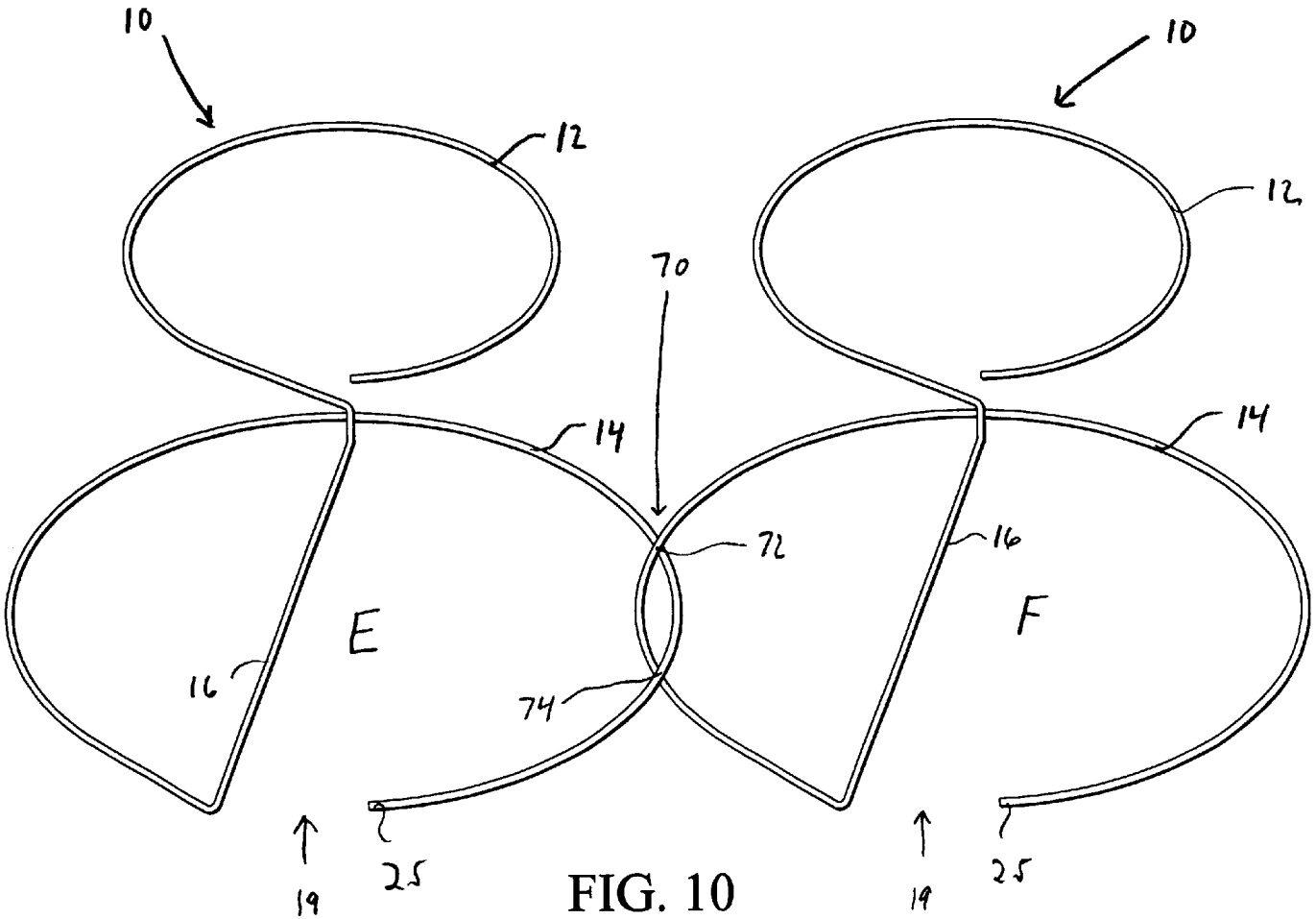
FIG. 10 is a perspective of the embodiment of FIG. 9.

Shown in FIG. 8 is an alternative embodiment of the present invention. A wire plant support 60 comprises an upper oval 62 and a lower oval 64 supported by a vertical portion 66. An additional vertical portion 68 is located between the upper oval 62 and lower oval 64 to provide more stability and support to the plant support 60. The additional vertical portion 68 may be formed in the plant support 60 when it is originally manufactured, or, it may be attached after the fact. The additional vertical portion 68 may be welded, fastened, or attached by other know methods to the upper and lower ovals. A plurality of additional vertical portions 68 may be added to the plant support as needed. An increased number of vertical portions 68 will provide more stability to the support to better enable the plant support to accommodate heavier containers.

The present invention is formed with an elongated bar or wire. The elongated bar is placed within a machine that forms a first curved portion that defines upper oval or ring 12 about a central axis. The first curved portion is formed to almost enclose the oval. However, a space 13 is left between the end of the curved portion 15 and the first end 11 of the elongated bar. A first bend is formed to define the second end of upper oval 12. A first portion 18 is formed to extend radially outwardly from the central axis. A second bend 28 is formed in the elongated bar, defining the end of first portion 18 and the beginning of vertical portion 16. Vertical portion 16 extends downwardly from bend 28 while projecting radially outwardly relative to the central axis. A third bend 23 is formed and defines the end of vertical portion 16 and the beginning of second portion 30. Second portion extends in a plane parallel to upper oval 12. A second curve is formed in the elongate bar to define the beginning of lower oval 14. Lower oval 14 formed to approach third bend 23 almost enclosing lower oval about the central axis. The machine then cuts the remaining elongate bar from the formed plant support 10. A space 19 is left between bend 23 and lower oval end 25.

The elongated bar of plant support 10 may be made of a wire material, such as metal, or a plastic. Preferably a galvanized metal, such as steel, or, an extruded plastic or coated plastic is used for support 10. These materials are preferred to prevent inclement weather, water, and acids and alkalis in soil from forming rust, and wasting or degrading the plant support. The elongated member is rigid to maintain its shape yet sufficiently malleable to be manipulated by a user to be adjusted to support various sized plant containers.

All portions of the plant support 10 are formed from the unitary elongate bar or wire. No attachment individual components is used, such as welding, soldering, applying epoxy, and wrapping. Plant support 10 is described as being made by a manufacturing or machining process. This forming process may be accomplished via any available machine. However, manual or other methods may be used to form the present invention.

Additionally, the present invention may be formed in varying sizes and dimensions to provide support for different sizes (volumes) of plant containers. For example, the present invention may be formed to accommodate a predetermined range of container sizes, such as 3 to 5 gallons, 5 to 7 gallons, 7 to 9 gallons, and the like.

The present invention provides a more stable plant support since each lower oval portion 14 is adjustable, via changing the lower oval diameter, to effectively provide a stable base for support. This minimizes the negative effect of stresses on the bends in the elongate member caused by the weight of the container being supported. A reduced impact on bent portions of the plant support prolongs the operational life of the plant support.

The shape of the present invention, as shown in the Figures, lends itself to easy stacking of a plurality of plant supports 10. The ability to stack a plurality of the plant supports enables a user to make efficient use of storage space.

While the present invention has been described with respect to a plant container support, likewise, other applications exist outside of the field of gardening and nursery devices in general. The present invention may be used as a support for items in general.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention is not limited in the particular embodiments that have been described in detail therein. Rather, reference should be made to the appended claims as indicative of the scope and content of the present invention.

What is claimed is:

1. An elongated member shaped so as to form a stackable plant support comprising:

an adjustable upper oval portion, the upper oval shaped so as to permit insertion of a plant container such that a portion of the plant container engages the upper oval portion and another portion of the plant container engages the ground;

an adjustable lower oval portion; and a vertical member connecting the upper oval portion to the lower oval portion, the vertical member supporting the upper oval portion in a substantially parallel spaced orientation with respect to the lower oval portion, the vertical member having:

a vertical portion positioned so as to trace a straight slant line of a frustum of a circular pyramid defined by the shape of the elongated member; and a straight portion oriented in the same plane as the upper oval portion and located between the upper oval portion and the vertical portion, and extending radially outwardly from the upper oval portion.

2. The elongated member of claim 1 wherein the lower oval portion has a larger diameter than the upper oval portion.

3. The elongated member of claim 2 wherein the upper and lower oval portions are oriented to form a spaced concentric configuration.

4. The elongated member of claim 3, wherein said elongated member is interlocked with at least one like elongated member.

5. The elongated member of claim 2 wherein the plant support is made of wire.

6. The elongated member of claim 5 wherein the wire is made of a galvanized metal.

7. The elongated member of claim 2 wherein the plant support is made of plastic.

8. The elongated member of claim 1 wherein the diameter of the lower oval portion is manually moveable between a first position and a second position.

9. The elongated member of claim 8 wherein the lower oval portion further comprises a first end and a second free end configured with a space therebetween, the size of the space changing as the diameter of the lower oval portion is adjusted between the first position and the second position.

10. The elongated member of claim 1 wherein a second straight portion is located between the vertical member and the lower oval portion, and extending radially outwardly from the lower oval portion.

11. The elongated member of claim 1 wherein the diameter of the upper oval portion is moveable between a first position and a second position.

12. The elongated member of claim 11 wherein the upper oval portion further comprises a first free end and a second end configured with a space therebetween, the size of the space changing as the diameter of the upper oval portion is adjusted between the first position and the second position.

13. The elongated member of claim 1 further comprising a second vertical portion connecting the upper oval portion to the lower oval portion.

14. A container support apparatus comprising, at least two moveable arcuate parallel vertically spaced horizontally disposed portions; and at least one vertical member attached to the at least two arcuate portions, such that the apparatus is adapted to support an associated container within a space defined by said at least two arcuate portions, the vertical member having:

a vertical portion positioned so as to trace a straight slant line of a frustum of a circular pyramid defined by the shape of the two arcuate portions; and a straight portion oriented in the same plane as one of the at least two moveable arcuate portions and located between one or the at least two moveable arcuate portions and the upper oval portion and the vertical portion; and the at least two arcuate portions are an upper oval portion and a lower oval portion, the lower oval portion having a larger diameter than the upper oval portion to define a tapered cylinder shape, the upper and lower oval portions shaped so as to facilitate the stacking of a plurality of container support apparatus and accommodate the insertion of a container within the container support apparatus such that the upper oval portion engages a portion of the container and another portion of the plant container engages the ground.

15. The container support apparatus of claim 14 further comprising a second vertical portion connecting said two arcuate portions.

16. The container support apparatus of claim 14 wherein said container support is interlocked with a like container support.

17. A method of supporting a plant container comprising:

providing a wire structure centered about a vertical axis, the wire structure having:

an upper oval portion vertically spaced and horizontally disposed from a lower oval portion, the upper oval portion and lower oval portion connected by a vertical member, the wire structure forming a generally tapered cylindrical shape and defining an interior volume, the vertical member having:

a vertical portion positioned so as to trace a straight slant line of a frustum of a circular pyramid defined by the shape of the elongated member; and a straight portion oriented in the same plane as the upper oval portion and located between the upper oval portion and the vertical portion and extending radially outwardly from the upper oval;

positioning the wire structure on the ground for using the wire structure as a support for containers, wherein the lower oval portion is adjusted to provide a base for the wire structure on the ground; and adjusting the upper oval portion to permit the insertion of the container into the interior volume, wherein a rim of the container is adapted to rest on the upper oval portion and another portion of the container engage the ground.

18. The method according to claim 17 wherein adjusting the upper oval portion comprises manually changing the diameter of the upper oval portion to accommodate the container.

19. The method according to claim 17 further comprising further manually changing the diameter of the lower oval portion to provide a stable support.

20. The method of supporting plant containers of claim 17 further comprising interlocking said wire structure with at least one like wire structure.

21. The method according to claim 17 further comprising, providing a second vertical portion connecting the upper oval portion to the lower oval portion.

22. A method of forming a manually adjustable container support comprising:

providing an elongated bar;

forming a first curved portion defining an upper ring, the upper ring manually adjustable to permit the insertion of a container within the upper ring with a portion of the container in contact with the upper ring;

forming a first bend;

forming a vertical member extending downwardly, the vertical member having:

a vertical portion positioned so as to trace a straight slant line of a frustum of a circular pyramid defined by the shape of the elongated member; and a linear portion oriented in the same plane as the upper ring extending radially outwardly and located between the upper ring and the vertical portion;

forming a second bend;

forming a second curved portion defining a lower ring, such that the upper and lower rings are in a vertically spaced and horizontally disposed, concentrically about a vertical axis;

cutting the remainder of elongated bar to form an end of the container support;

permitting insertion of a container for support wherein the diameter of the first curved portion is changed; and stabilizing the container support wherein the diameter of the second curved portion is manually changed.

23. The method of forming a container support according to claim 22 further comprising:

forming a second portion extending between the vertical member and the second curved portion, the second portion being straight.

24. The method of forming a container support according to claim 22 further comprising forming said container support via use of machinery.

25. The method of forming a container support according to claim 22 further comprising, providing a second vertical portion connecting the upper ring to the lower ring.

26. An elongated member constructed of a single continuous wire shaped so as to form a plant support comprising:

a manually adjustable upper oval portion defined by a first free end, a second end, and a space between the first free end and the second end, the upper oval portion shaped so as to permit insertion of a plant container;

a manually adjustable lower oval portion defined by a first end, a second free end, and a space between the first end and the second free end, the lower oval portion shaped so as to complementarily engage a surface;

a vertical member connecting the upper oval portion to the lower oval portion, the vertical member supporting the upper oval portion in a substantially parallel spaced orientation with respect to the lower oval portion, the vertical member having:

a substantially linear elongated vertical portion;

a first straight horizontally disposed portion located between the upper oval portion and the vertical portion; and a second straight horizontally disposed portion located between the vertical portion and the lower oval portion.

27. The elongated member of claim 26 wherein the lower oval portion has a larger diameter than the upper oval portion.

28. The elongated member of claim 26 wherein the upper and lower oval portions are oriented to form a spaced concentric configuration.

29. The elongated member of claim 28 wherein the member is made of plastic.

30. The elongated member of claim 28 wherein the member is made of a galvanized metal.

31. The elongated member of claim 28 wherein said elongated member is interlocked with at least one like elongated member.

32. The elongated member of claim 26 wherein said vertical portion is positioned so as to trace a slant line of a frustum of a circular pyramid.

33. The elongated member of claim 26 further comprising a second vertical portion connecting the upper oval portion to the lower oval portion.

* * * * *